United States Patent [19]

Litjens et al.

[11] Patent Number: 4,842,559

[45] Date of Patent: Jun. 27, 1989

[54] POSITION CONTROL SYSTEM FOR A MARINE PROPULSION DEVICE

[75] Inventors: John J. Litjens, Omro; John M. Griffiths, Fond du Lac; Michael A. Karls, Hilbert, all of Wis.

[73] Assignee: Brunswick Corporation, Skokie, Ill.

[21] Appl. No.: 172,399

[22] Filed: Mar. 24, 1988

[51] Int. Cl.[4] ..... B63H 21/26

[52] U.S. Cl. ..... 440/1; 440/53; 440/61; 440/88

[58] Field of Search ..... 440/1, 53, 61, 88; 248/641

[56] References Cited

U.S. PATENT DOCUMENTS

| | | | |
|---|---|---|---|
| 2,737,920 | 3/1956 | Heath . | |
| 2,782,744 | 2/1957 | Staley . | |
| 3,990,660 | 11/1976 | Pipoz . | |
| 4,013,249 | 3/1977 | Meyer et al. . | |
| 4,019,489 | 4/1977 | Cartmill | 123/41.15 |
| 4,168,818 | 9/1979 | Ellis . | |
| 4,306,703 | 12/1981 | Finze . | |
| 4,318,699 | 3/1982 | Wenstadt et al. . | |
| 4,354,848 | 10/1982 | Hall et al. . | |
| 4,363,629 | 12/1982 | Hall et al. . | |
| 4,367,860 | 1/1983 | Strang . | |
| 4,384,856 | 5/1983 | Hall et al. . | |
| 4,406,632 | 9/1983 | Blanchard . | |
| 4,406,634 | 9/1983 | Blanchard . | |
| 4,482,332 | 11/1984 | Emmons . | |
| 4,504,237 | 3/1985 | Blanchard . | |
| 4,565,528 | 1/1986 | Nakase | 440/1 |
| 4,600,395 | 7/1986 | Pichl | 440/61 |
| 4,605,375 | 8/1986 | Ferguson | 440/1 |
| 4,673,358 | 6/1987 | Iwai et al. | 248/640 |
| 4,682,961 | 7/1987 | Nakahama . | |
| 4,713,028 | 12/1987 | Duff | 440/61 |
| 4,718,872 | 1/1988 | Olson et al. | 440/1 |
| 4,757,971 | 7/1988 | Mapes | 440/1 |
| 4,759,732 | 7/1988 | Atsumi | 440/1 |

FOREIGN PATENT DOCUMENTS

| | | | |
|---|---|---|---|
| 2071759 | 9/1981 | United Kingdom | 440/88 |

*Primary Examiner*—Sherman D. Basinger
*Assistant Examiner*—Thomas J. Brahan
*Attorney, Agent, or Firm*—Andrus, Sceales, Starke & Sawall

[57] ABSTRACT

A position control system for a marine propulsion device senses an undesirable operating condition in the propulsion engine, such as low cooling water pressure at high speed or high engine temperature, to automatically lower the drive unit to a position in which the undesirable operating condition is likely to be alleviated. The system may include a logic timer circuit which will lower the drive unit for a short period of time, hold it in that position if the undesirable condition has been eliminated, or lower the drive unit further if the undesirable operating condition remains. The position control system may be incorporated into a conventional lift system, particularly a lift system used with a transom extension mounting assembly.

14 Claims, 4 Drawing Sheets

POSITION CONTROL SYSTEM FOR A MARINE PROPULSION DEVICE

BACKGROUND OF THE INVENTION

The present invention relates to a system for controlling the position of marine propulsion devices, and more particularly to a position control system for a transom extension mounting assembly for an outboard motor.

Marine propulsion devices, such as outboard motors and stern drives, are supported from a boat transom by a drive mounting assembly. Various types of drive mounting assemblies are known, as for example a transom bracket for mounting an outboard motor directly on a boat transom or a gimbal ring assembly for likewise mounting a stern drive unit directly to the transom. While the drive unit may be trimmed when mounted directly on a transom, the motor's vertical height cannot be changed beyond the somewhat limited amount resulting from trimming operation. Therefore, the drive unit is typically mounted in a compromise position at a fixed height which will provide the best possible performance. Another type of drive mounting assembly relates to one which is capable of selectively supporting an outboard motor in either raised or lowered positions wholly aft of the boat transom. Many of these latter transom extension types of mounting assemblies are of the general type which include a parallelogram linkage.

Recently, transom extension mounting assemblies have become increasingly popular on high performance outboard motor powered boats, including bass boats where a lower position of the motor improves initial boat acceleration, and a higher position enhances top speed by reducing gear case drag. Additionally, a higher motor position reduces draft, thereby enhancing shallow water operation. It is further known that relocating the motor aft of the transom improves the handling characteristics of most boats at high speeds. These devices also allow the boat to have a higher transom for improved safety in following-wave conditions and they allow boat builders to manufacture a common hull/-transom design for both outboard and stern drive applications.

Examples of outboard motor mounting assemblies which support the outboard motor wholly aft of the boat transom are disclosed in the following United States patents:

| U.S.Pat. No. | Inventor | Issue Date |
|---|---|---|
| 2,737,920 | Heath | 1956 |
| 2,782,744 | Staley | 1957 |
| 3,990,660 | Pipoz | 1976 |
| 4,013,249 | Meyer et al | 1977 |
| 4,168,818 | Ellis | 1979 |
| 4,306,703 | Finze | 1981 |
| 4,354,848 | Hall et al | 1982 |
| 4,363,629 | Hall et al | 1982 |
| 4,367,860 | Strang | 1983 |
| 4,384,856 | Hall et al | 1983 |
| 4,406,632 | Blanchard | 1983 |
| 4,406,634 | Blanchard | 1983 |
| 4,482,332 | Emmons | 1984 |
| 4,504,237 | Blanchard | 1985 |

U.S. patent application Ser. No. 092,168, filed Sept. 2, 1987, Ser. No. 100,216, filed Sept. 23, 1987, and Ser. No. 103,508, filed Oct. 1, 1987, all of which are assigned to the assignee of this application, disclose outboard motor transom extension mounting assemblies utilizing a quadrilateral linkage arrangement to raise and lower the motor with respect to the transom. In particular, pending application Ser. No. 092,168 discloses the use of sensing means operatively connected to the fluid power assembly utilized to raise and lower the motor, which sensing means generates a signal representative of an undesirable water level to cause the motor to be raised to a higher position. The undesirable water level may result, for example, in boat launching or in following wave conditions caused by rapid deceleration.

U.S. Pat. No. 4,318,699 discloses a system for automatically trimming a marine drive unit in response to a sensed operating condition, such as engine speed. A trimming operation involves tilting the drive unit about a horizontal axis to optimally position the drive in on-plane and off-plane operation of the boat.

Another problem which has become more apparent with the increased use of transom extension mounting assemblies for outboard motors is engine damage which may occur due to a loss of cooling water pressure. The shallow draft at which the motor may be operated when lifted vertically to enhance performance, may inhibit the intake and circulation of engine cooling water. The loss of cooling water pressure may lead to engine overheating and, ultimately, to damage to the engine. However, at low engine speeds, marine propulsion devices typically operate at low cooling water pressure with no danger of detrimental overheating or engine loss.

Many marine propulsion devices, including some outboard motors, utilize an engine block temperature sensor to provide an engine temperature measurement to the boat operator. Some systems also utilize a temperature sensor signal representative of a dangerous overheat condition to sound an audible alarm.

However, it would be desirable to have a position control system for a marine propulsion device which would automatically lower a motor operating in a raised position in the event an undesirable operating condition occurs in the engine. In particular, a system automatically responsive to the overheating potential of high performance engines operating in a high lift/shallow draft mode would be most desirable.

SUMMARY OF THE INVENTION

The present invention provides a position control system for a transom-mounted marine propulsion device, particularly an outboard motor mounted on a transom extension assembly, which utilizes a sensed undesirable engine operating condition to generate a signal which is utilized to actuate the apparatus for raising and lowering the device to move it to a lower position.

A mounting assembly for a marine propulsion device comprises a mounting means for supporting a marine propulsion device wholly aft of a boat transom, said mounting means includes a first portion attachable to a boat transom and a second portion adapted to support the marine propulsion device, means for moving the second portion relative to the first portion to move, by raising and lowering, the marine propulsion device relative to the boat transom, sensor means for sensing an undesirable operating condition in the marine propulsion device and for generating a signal indicative of the undesirable operating condition, and means responsive to the undesirable condition signal for actuating said moving means to move the marine propulsion device to a lower position.

In its preferred form, the mounting means includes a first bracket attachable to the boat transom having upper and lower ends, and a second bracket having upper and lower ends spaced aft of the first bracket and adapted to support the marine propulsion device, an upper link pivotably connected at its ends to the upper ends of the first and second brackets, and a lower link pivotally connected at its ends to the lower ends of the first and second brackets. The brackets and links may form a parallelogram linkage which raises and lowers an outboard motor in a substantially vertical direction.

The moving means may comprise fluid cylinder means operatively connected between the brackets and links of the motor mounting means for effecting movement of an outboard motor through pivotal movement of the brackets and links. In one form, the fluid cylinder means has its cylinder end connected to the pivotable connection between one of the links and one of the brackets, and its rod end connected to the pivotable connection between the other of the links and the other of the brackets.

An undesirable operating condition may include either low engine cooling water pressure and high engine speed or high engine temperature. The sensor means therefore includes a cooling water pressure sensor, an engine speed sensor, and an engine temperature sensor. An actuating means is responsive in one mode to a signal indicating low water pressure and high engine speed (or to a signal indicating high temperature) to operate the fluid cylinder means to move the outboard motor to a lower position. In a preferred embodiment, the actuating means includes a timer logic control means responsive to the low pressure/high speed signal to operate the fluid cylinder means for a first preset time period, to hold the motor in the lower position for a second preset time period and to repeat the lowering and holding sequence if the undesirable low pressure/-high speed condition remains at the end of the second preset time period.

The timer logic control means is also independently responsive to a high engine temperature signal to operate the fluid cylinder means to move the motor to an intermediate lower position. The control means may also be utilized to hold the motor in an intermediate position in a manner similar to operation in response to the low pressure/high speed signal.

The system of the present invention may also be used with a conventional drive unit trim control system, such as the type used on stern drive units.

The system may also include an override feature which allows the operator to bypass the automatic operation of the system regardless of the existence of an actual undesirable operating condition or the sensing by the system of an apparent undesirable operating condition.

DETAILED DESCRIPTION OF THE PREFERRED EMBODIMENT

Figure 1:
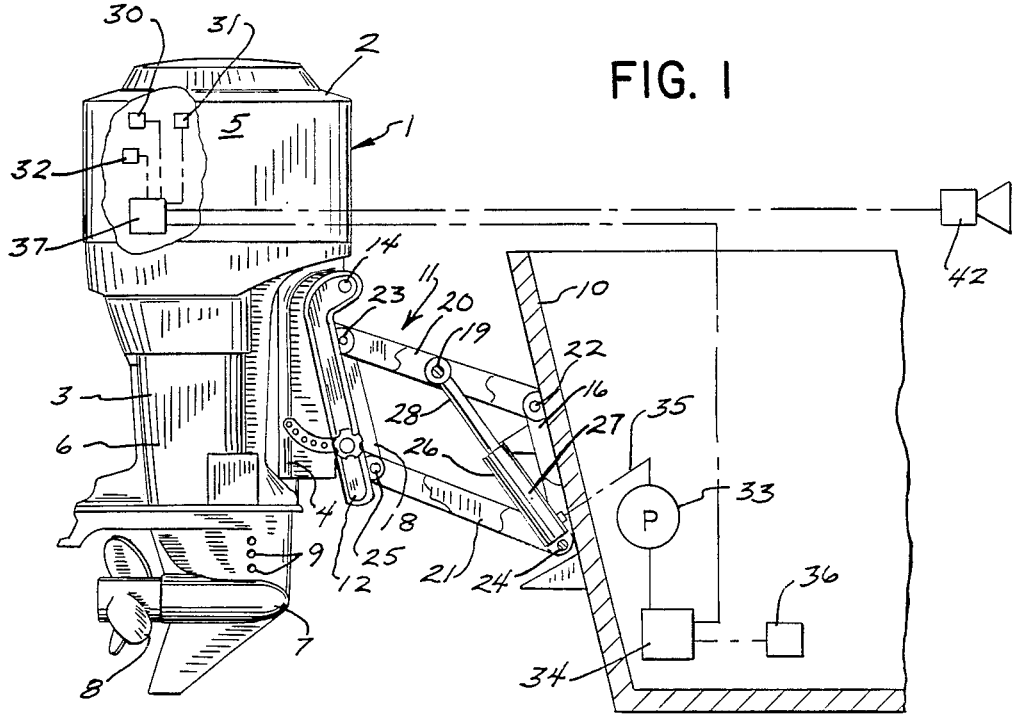
FIG. 1 is a side elevation view of an outboard motor and its transom mounting assembly, including a schematic representation of the control system of the present invention, with the motor shown in its raised position.

Referring to the drawing, a marine propulsion drive or device comprises an outboard motor 1 including an upper unit or powerhead 2, a lower unit 3, and a swivel bracket 4. The upper unit 2 includes a cover or cowl 5 providing an engine compartment for housing a water cooled internal combustion engine (not shown).

The lower unit 3 is rigidly mounted to the bottom of the powerhead 2 and includes a driveshaft housing 6 and a gear case 7. The gear case 7 is submerged during operation of the outboard motor 1 and supports a propeller shaft to which is mounted a drive propeller 8. The gear case 7 also houses a transmission assembly which connects the propeller shaft to a driveshaft extending through the driveshaft housing 6 and operatively connected at its upper end to the engine.

The gear case 7 is also provided with cooling water inlets 9 which pick up and direct cooling water to a pump located within the driveshaft housing 6 and driven by the engine driveshaft. Cooling water is pumped upwardly through a conduit in the driveshaft housing 6 and into and through the cooling water jacket in the engine block.

The lower unit 3 is connected to the swivel bracket 4 for turning movement about a substantially vertical axis to provide steering control for the outboard motor 1 in a conventional manner.

The outboard motor is supported from the transom 10 of a boat by a motor mounting assembly 11 and a transom bracket 12 on which the swivel bracket 4 is mounted. The motor is attached by the mounting assembly 11 to the transom bracket 12 for pivotal tilting movement about a horizontal axis and in a vertical plane between an operating position in which the gear case 7 and propeller 8 are fully submerged and in an upwardly tilted position in which the gear case 7 and propeller 8 are raised out of the water, as for trailering.

The transom bracket 12 includes two spaced clamping members 13 (only one of which is shown in the drawing) for demountably attaching the outboard motor 1 to the mounting assembly 11. Clamping members 13 are connected by a pivot pin 14 defining the axis for the pivotal tilting movement of the motor.

The mounting assembly 11 comprises a quadrilateral linkage including a first transom mounting bracket 16 adapted to be attached to the transom 10 in a conventional manner, such as by bolting the bracket 16 directly to the transom 10, a second motor supporting bracket 18 to which the outboard motor may be demountably attached with the clamping members 13 in a conventional manner or to which the transom bracket 12 may be directly bolted. The mounting assembly 11 further includes an upper link 20 extending between the upper ends of first and second brackets 16 and 18, and a lower link 21 extending between the lower ends of brackets 16 and 18. Links 20 and 21 each includes a forward end adjacent to the transom 10 and an aft end adjacent to the motor 1. Forward end of upper link 20 is pivotally connected at 22 to the upper end of the first transom mounting bracket 16, and the aft end of upper link 20 is pivotally connected at 23 to the upper end of the second motor supporting bracket 18. Likewise, the forward end of lower link 21 is pivotally connected at 24 to the lower end of transom mounting bracket 16, and the aft end of lower link 21 is pivotally connected at 25 to the lower end of motor supporting bracket 18. The brackets 16 and 18 and links 20 and 21 may be in the form of substantially solid plates to provide stability and rigidity to the mounting assembly 11. The brackets and links may also comprise a more open construction, particularly as may be needed to accommodate attachment of the clamping members 13, if the motor 1 is to be demountably attached to the motor supporting bracket 18. The pivotal connections 22-25 may comprise conventional pins which extend through the interconnected components.

In the embodiment shown, the quadrilateral linkage of the mounting assembly 11 is in the form of a parallelogram wherein the brackets 16 and 18 are of equal length and the links 20 and 21 are of equal length. However, a non-parallelogram linkage may also be utilized. For example, the bracket 16 may be shorter in length than bracket 18 or link 20 may be shorter in length than link 21.

Figure 2:
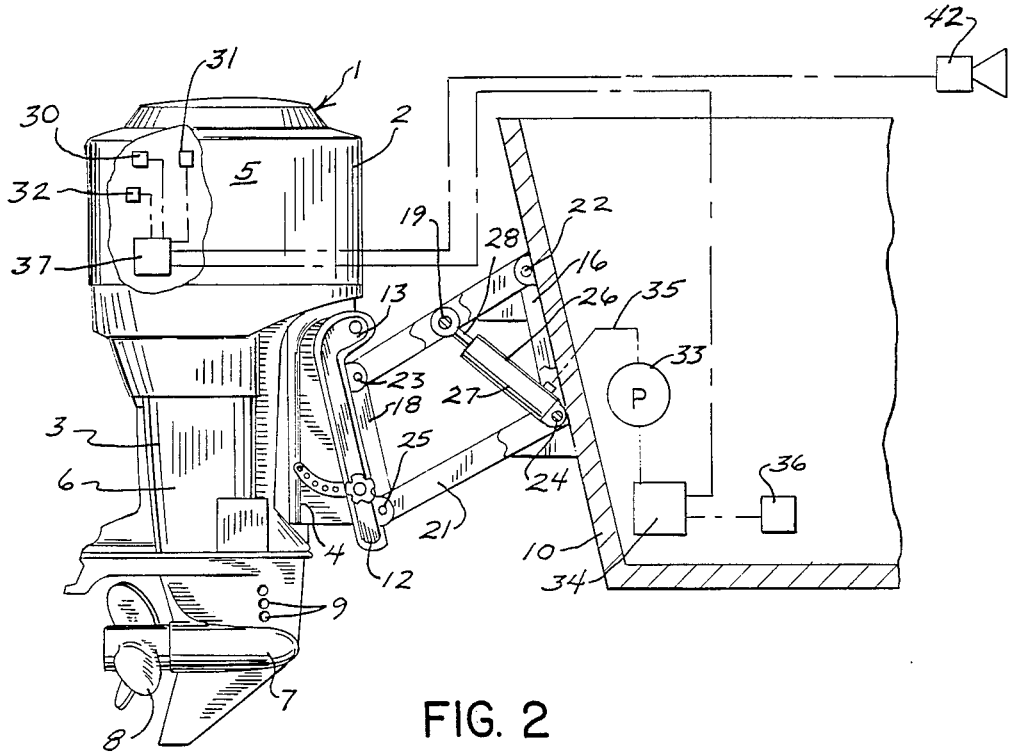
FIG. 2 is a side elevation view similar to FIG. 1, but showing the motor in its lowered position.

Means is also provided for selectively moving the motor supporting bracket 18 relative to the transom mounting bracket 16 and the transom 10, between a first position locating the motor supporting bracket 18 (and the attached motor 1) in a fully lowered position, as shown in FIG. 2, and second position locating the motor supporting bracket 18 in a fully raised position, as shown in FIG. 1. The moving means preferrably comprises a double acting hydraulic cylinder 26 having a cylinder end 27 and a rod end 28 mounted and extending between opposite sides of the mounting assembly 11. As shown in the drawing, the cylinder end 27 of the hydraulic cylinder 26 is connected to the pivotal connection 24 and the rod end 28 is attached to an intermediate pivot point 19 at approximately the center of the upper link 20. Alternatively, but not shown, the rod end 28 may be connected to the pivotal connection 23 between the aft end of upper link 20 and the upper end of the motor supporting bracket 18. The cylinder end 27 may likewise be attached at a different point, such as along forward bracket 16 above or below the pivotal connection 24. In any of the alternative constructions, extension of cylinder 26 will cause the bracket 18 and motor 1 to be moved to an elevated or raised position, while retraction of the cylinder 26 will cause the bracket 18 and motor 1 to be moved to a lowered position.

With the parallelogram configuration of the mounting assembly 11 shown in the drawing, extension and retraction of the hydraulic cylinder 26 causes the motor 1 to move straight up and down in a vertical plane without any upward or downward tilting of the motor in that plane. However, such tilting would occur were a non-parallelogram quadrilateral linkage used for the mounting assembly 10.

Operation of the boat with the motor 1 in the fully raised position shown in FIG. 1 may result in the motor being lifted substantially out of the water and cause the intake of cooling water by the inlets 9 to be reduced or impeded. A decrease in the volume of cooling water taken in and available for circulation by the pump will result in a decrease in pressure in the cooling water circulation system. Continued operation at low cooling water pressure, particularly at high speed, will result in an increase in engine temperature which, if maintained, could result in overheating and eventual damage to the engine.

Thus, either low cooling water pressure (particularly at high speed) or high engine temperature is an undesirable operating condition or potentially damaging condition. The control system of the present invention provides sensor means which sense and generate a signal indicative of the undesirable or potentially damaging operating condition and utilizes the signal to automatically move the drive unit to a lower position to increase the volume intake of cooling water through the cooling water inlets 9. In the preferred embodiment, an undesirable operating condition is either the combination of low water pressure and high engine speed, or high engine temperature. At low engine speeds, water pressure is typically low, but damage due to overheating is usually not a problem.

Operatively attached to the engine and shown schematically in the drawing are a water pressure sensor 30, an engine speed sensor 31, and a temperature sensor 32. The pressure sensor 30 is utilized to continuously monitor the pressure generated by the pump in the cooling water system and, in the preferred embodiment, to generate a signal if the pressure drops to or below 6 psi. The actual low pressure condition which results in an undesirable operating condition may, however, vary with different types of engines. The engine speed sensor 31 may be of a conventional type that measures engine rpm and generates an appropriate speed signal. The use of speed sensing means is known to provide a signal for a conventional tachometer and such signals have been used to power automatic trim control systems, as previously indicated. An engine speed above 1500 rpm may, for example, be selected as the high speed condition which, along with low water pressure, comprises an undesirable operating condition.

The temperature sensor 32 may also be of conventional construction, such as are now utilized in temperature monitoring systems that provide a direct temperature readout to the operator. Some existing temperature sensing systems include means for generating a signal indicative of high temperature and utilizing the signal to actuate an audible warning, such as a horn. The signal from such a temperature sensing system could be utilized directly in the control system of the subject invention to provide the high temperature signal indicative of that undesirable operating condition. The specific temperature used to generate the high temperature signal may of course be varied to suit specific operating conditions or engine types.

The hydraulic cylinder 26 used to move the motor 1 between its raised and lowered positions receives operating fluid pressure from a hydraulic pump 33 which may be driven by an electric motor 34, both of which are located within the boat. The circuit for the supply and return of hydraulic fluid between the pump 33 and the cylinder 26 is shown schematically at 35. In a conventional lift system, the motor and pump may be manually activated by the boat operator via a conventional up/down switch 36.

A control module 37, which may be mounted adjacent the engine within the cowl 5, provides the necessary control in response to sensor signals indicative of an undesirable operating condition to actuate the electric motor 34 and pump 33 to lower the motor 1. Thus, the sensing by water pressure sensor 30 of a low pressure condition and the simultaneous sensing by engine speed sensor 31 of a high speed condition will cause the control module 37 to actuate the motor and pump 34 and 33 to lower the outboard motor 1. Alternatively, the existence of a high temperature condition will be sensed by temperature sensor 32 and a high temperature signal will be transmitted to the control module 37 and also result in operation of the pump 33 to lower the motor 1.

The control module 37 preferably includes a timer logic control responsive to one or both of the signals representative of an undesirable operating condition to operate the pump 33 and lower the motor 1 for a short preset time period, for example one second, deactivate the pump and hold the motor in the lower position for a second preset time period, such as three seconds, and repeat the lowering and holding cycle if the undesirable operating condition still exists. Each short period of pump operation will lower the motor about one to two inches. If the undesirable operating condition has been corrected, the motor will remain in the position to which it was first lowered.

The second preset time period, during which operation of the pump is terminated and the position of the motor is held, is sufficient to allow the pressure or the temperature to stabilize before the sensed condition is rechecked and processed by the control module 37. Selection of the low pressure limit, the specific high temperature condition, and the first and second preset time periods are intended, under particularly adverse operating conditions, to enable the lowering/holding cycle to repeat rapidly enough to cause the motor to move to its fully lowered position before overheating would typically result in permanent damage to the powerhead. The intermittent lowering of the engine provided by the timer logic control minimizes the risk of affecting handling characteristics such as might result from too great a drop in engine position at one time. Too rapid or too great a vertical change in engine height (without an intermediate pause) could result in a sharp torque increase and possible impairment of control.

The timer logic control in the control module 37 also preferably responds to a high engine temperature signal in the same manner as its response to the combined low pressure/high speed signal, previously described. Thus, the sensing of a high temperature condition will result in generation of a signal to activate the pump motor and lower the outboard motor. The motor is held for the second preset time period and the cycle is repeated if the powerhead temperature still has not dropped enough to eliminate the high temperature signal.

Figure 3A:
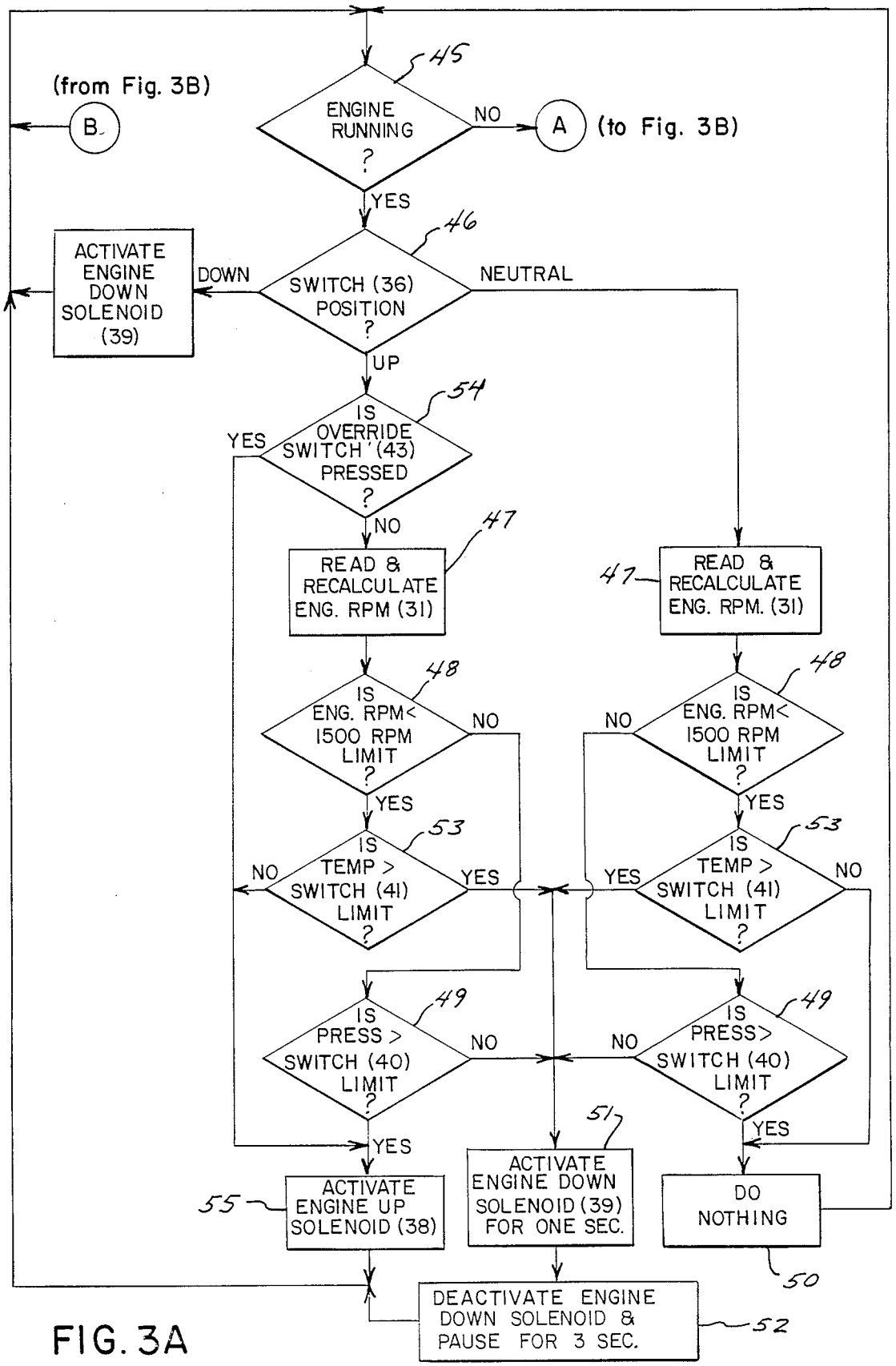
FIG. 3A is a logic diagram showing operation of the preferred embodiment of a part of the system of the present invention.
Figure 3B:
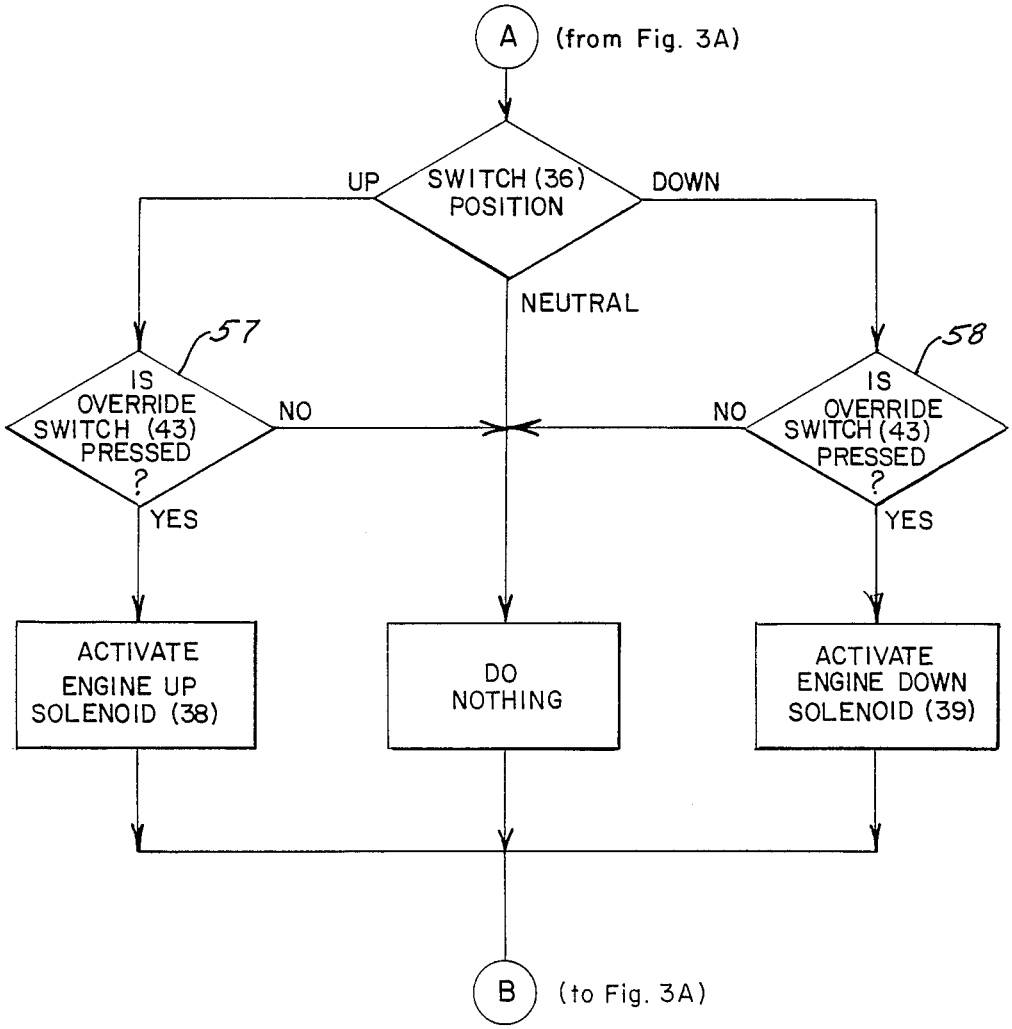
FIG. 3B is a logic diagram showing operation of the remainder of the system shown in FIG. 3A.

The logic diagram of FIGS. 3A and 3B outlines the process provided by the control system of the present invention and implemented by the control module 37. Beginning with decision step 45, if the engine is running, and at decision step 46 the up/down switch 36 is in the neutral position, the continuous monitoring of engine speed (rpm) by speed sensor 31 at process step 47 provides a speed signal for decision step 48. If the engine speed is not less than the 1500 rpm limit, the high speed signal is combined with the sensed pressure signal at decision step 49 to determine the existence of a high speed/low pressure undesirable operating condition. If the cooling water pressure at decision step 49 is greater than the low pressure limit, switch 40 will remain open and the lift system remains inoperative ("do nothing" process step 50). If the sensed cooling water pressure is equal to or less than the lower pressure limit, pressure switch 40 will close to activate the down solenoid 39 (at process step 51) to lower the engine for the first preset time period of one second. After one second, the down solenoid 39 is deactivated at process step 52 and the motor is held in the initial lower position for the second preset time period of three seconds. If after the three second pause, the undesirable high speed/low pressure operating condition remains, the lowering/pausing cycle automatically repeats.

If the sensed engine speed at decision step 48 is less than the 1500 rpm limit, the sensed engine temperature is utilized at decision step 53 where a temperature in excess of the high temperature limit will close temperature switch 41 to activate the down solenoid 39 at process step 51, to initiate the lowering/pausing cycle previously described. If the sensed engine temperature is less than the high temperature limit, temperature switch 41 remains open and the lift system remains inoperative (at process step 50).

Referring again to decision step 46, operator activation of the down mode of up/down switch 36 when the engine is running will activate the down solenoid 39 and result in downward movement of the outboard motor. However, operator engagement of the up mode of switch 36 will not result in activation of the up solenoid 38 unless, at decision step 54, an override switch 43 is simultaneously activated by the operator. If the override switch is not pressed, the control module 37 simply continues to operate in the automatic mode through decision steps 48, 49 and 53 previously described. If an adverse operating condition exists, the engine will not move upwardly.

However, if the override switch 43 is operated at decision step 54 simultaneously with the up switch, the up solenoid 38 will be activated at process step 55 and the engine will be lifted, regardless of the existence of an undesirable operating condition.

If the engine is not running at decision step 45 (point A in FIG. 3A corresponding to point A in FIG. 3B), operation of the pump motor 34 by activation of the up or down solenoid 38 or 39 to raise or lower the motor requires simultaneous activation of the override switch 43 at decision step 57 or 58, respectively. If the override switch 43 is not pressed, the system will "do nothing". Point B in FIG. 3B also corresponds to point B in FIG. 3 to close the logic loop back to the initial decision step 45.

Figure 4:
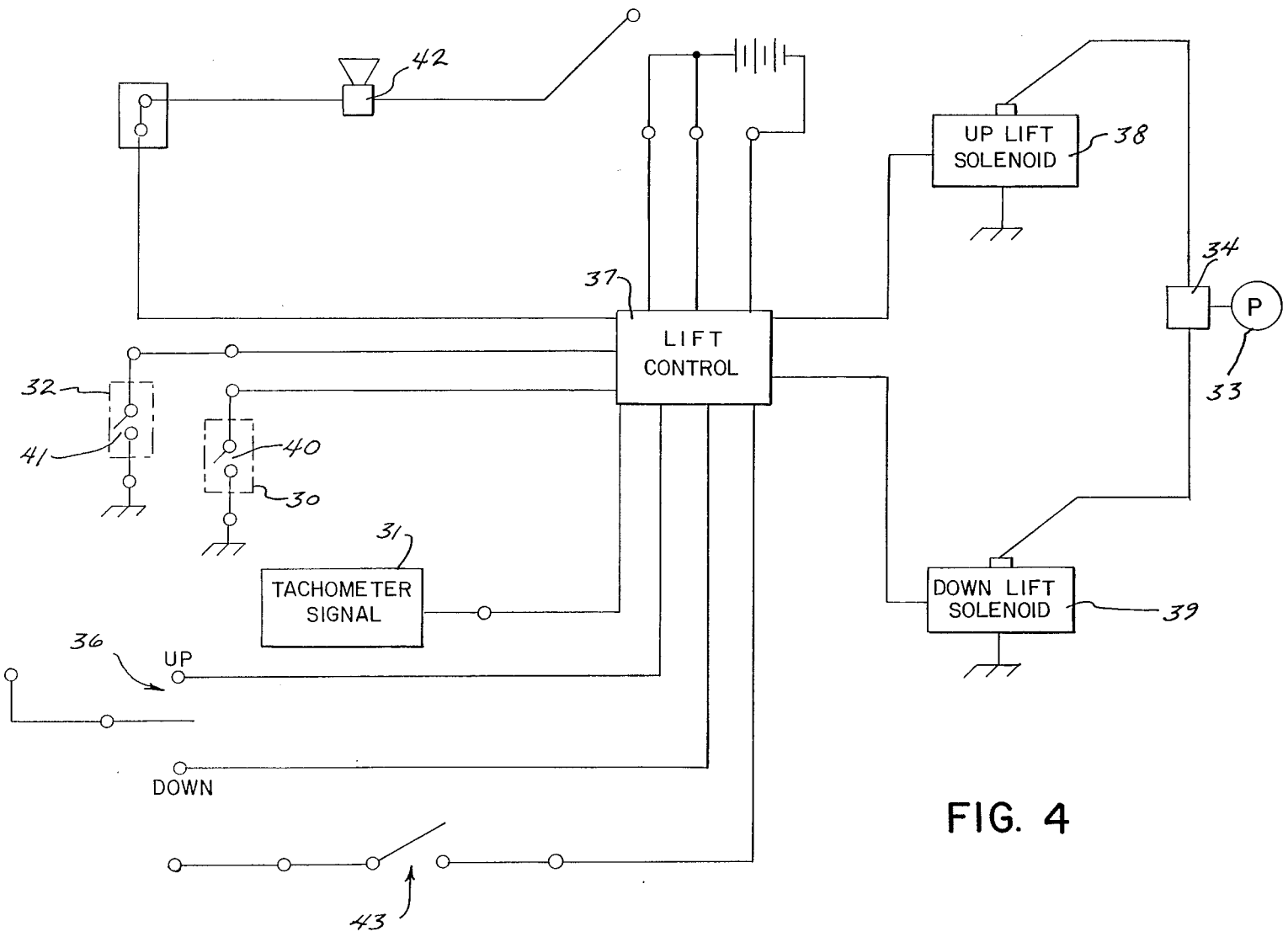
FIG. 4 is an electrical schematic of the control system of the present invention incorporated into a conventional lift system.

The electrical schematic of FIG. 4 shows how the control system of the present invention may be incorporated into a conventional marine engine lift system. Current to operate the pump motor 34 is supplied via an up solenoid 38 or a down solenoid 39, each of which functions as a relay, in response to control current supplied by operator actuation of the up/down switch 36. Current supplied from the up solenoid 38 to the motor 34 operates the pump 33 in one direction to extend the cylinder 26 and lift the motor 1. Correspondingly, the down solenoid 39 operates the motor 34 in the opposite direction to reverse the pump 33 and cause the cylinder 26 to retract and lower the motor 1. This is the basic operation of a conventional lift system.

The control system of the present invention may utilize a conventional speed sensor 31, comprising part of a tachometer system, to supply the high engine speed signal comprising one element of the combined signal indicative of an undesirable operating condition. The other element of the combined signal is the low water pressure signal provided by the pressure sensor 30. The pressure sensor includes a pressure switch 40 which is adapted to close at a selected low pressure level, such as 6 psi, to provide the other element of the combined signal. The low pressure signal and the high speed signal, for example a signal indicative of an engine speed in excess of 1500 rpm, are combined and processed by the control module 37 to signal the down solenoid 39 to lower the motor 1.

The control module 37 includes a timer logic circuit which is responsive to the combined low pressure/high speed signal to operate the motor 34 in the down direction for a first preset time period, such as 1 sec. as previously described. At the end of the first preset time period, the pump motor 34 is deactivated and the outboard motor 1 is held in the initial lower position for a second preset time period, such as 3 sec. If the undesirable operating condition resulting in the low pressure/high speed signal remains after the second preset time period, the control module 37 will cause the lowering/holding cycle to repeat until either of the conditions of low pressure or high speed is eliminated.

The control system may utilize a conventional temperature sensor 32 which includes a temperature switch 41 adapted to close at an undesirable high engine temperature and activate a warning horn 42. In the system of the present invention, the high temperature signal is processed by the control module 37 to activate the down solenoid 39 and the pump motor 34 to lower the outboard motor 1. The timer logic circuit in the control module 37 is preferably utilized to intermittently lower and hold the outboard motor until the high temperature condition is eliminated, in a manner similar to the low pressure/high speed condition.

The control module 37 is also designed to provide other control features which are either necessary or convenient for the safe and effective operation of the lift control system. Thus, manual operation of the switch 36 in the "up" mode is disabled as long as an undesirable operating condition exists. However, a manual override function is desirable to provide up operation even though a low pressure/high speed or high temperature operating condition exists. For example, it may be necessary to raise the outboard motor to avoid an underwater obstruction or to operate in shallow water, even though an undesirable operating condition exists. Thus, a system override switch 43 may be utilized to be manually operated, simultaneously with the "up" mode of switch 36 to cause the motor to be lifted regardless of other operating conditions. The override switch must also be used with the "up" (or "down" ) switch to raise (or lower) the motor when the engine is not running (and there is therefore zero water pressure). The override switch 43 may conveniently comprise the trailering switch typical of a conventional system.

The control system of the present invention may also be utilized with a conventional hydraulic trim or trim/tilt control system, of the type used with either an outboard motor or a stern drive propulsion device. A conventional trim control system utilizes a double acting hydraulic cylinder or cylinders which are operated in a manner similar to the cylinder 26 used in the lift system described herein. A trim/tilt system may utilize separate hydraulic cylinders for the trim and for the tilt functions. However, with either system, the automatic position control, provided for a lift system in accordance with the preferred embodiment of the invention, may be applied as well to provide automatic position control in a trim or trim/tilt system.

Various modes of carrying out the invention are contemplated as being within the scope of the following claims particularly pointing out and distinctly claiming the subject matter which is regarded as the invention.

We claim:

1. A position control system for a transom-mounted marine drive unit driven by a water-cooled engine, said system comprising:

(a) means for mounting the drive unit to the boat transom for movement of the drive unit between raised and lowered positions relative to the boat transom;

(b) fluid power means for moving the drive unit to and maintaining the same in a position at or between said raised and lowered positions;

(c) sensor means for sensing an undesirable operating condition in the drive unit and for generating a signal indicative of said undesirable operating condition said sensor means including an engine temperature sensor, an engine cooling water pressure sensor, and an engine speed sensor;

(d) means responsive to said signal for actuating fluid power means to move the drive unit to a lower position.

2. The control system as defined in claim 1 wherein the actuating means is responsive to a signal indicative of low water pressure and high engine speed.

3. The control system as defined in claim 2 wherein the actuating means is responsive to a signal indicative of high engine temperature.

4. The control system as defined in claim 3 wherein the fluid power means comprises an hydraulic trim control system.

5. The control system as defined in claim 3 wherein the fluid power means comprises an hydraulic lift system.

6. A position control system for a transom-mounted outboard boat motor including a water-cooled engine, said system comprising:

mounting means for supporting the outboard motor aft of the boat transom, said mounting means including a first portion attachable to a boat transom and a second portion adapted to support the outboard motor;

means for moving said second portion relative to said first portion to move the outboard motor between raised and lowered positions relative to the boat transom;

sensor means including an engine cooling water pressure sensor and an engine speed sensor for sensing an undesirable operating condition in the outboard motor and for generating a signal indicative of said undesirable operating condition; and means responsive to said signal for actuating said moving means to move the outboard motor to a lower position.

7. The position control system of claim 6 wherein said mounting means includes:

a first bracket attachable to the boat transom, said first bracket having upper and lower ends;

a second bracket spaced aft of said first bracket and adapted to support the outboard motor, said second backet having upper and lower ends;

an upper link pivotally connected as its ends to said upper ends of said first and second brackets; and a lower link pivotally connected at its ends to said lower ends of said first and second brackets.

8. The position control system of claim 7 wherein said moving means includes fluid cylinder means operatively connected between said brackets and links for effecting movement of said outboard motor through pivotal movement of said brackets and links.

9. The position control system of claim 8 wherein said fluid cylinder means includes a cylinder end connected to the pivotal connection between one of said links and one of said brackets and a rod end connected to the pivotal connection between the other of said links and the other of said brackets.

10. The position control system of claim 9 wherein said sensor means is mounted on said outboard motor.

11. The position control apparatus of claim 10 wherein said actuating means if responsive to a first signal indicative of a condition of a low water pressure and high engine speed.

12. The position control system of claim 11 wherein said sensor means further comprises an engine temperature sensor.

13. The position control system of claim 12 wherein said actuating means is responsive to either of a first signal indicative of a condition of low water pressure and high engine speed or a second signal indicative of a condition of high engine temperature.

14. The position control system of claim 13 wherein said actuating means further comprises timer logic control means responsive to one of said first and second signals for operating said moving means for a first preset time period, for holding said moving means in the lower position for a second preset time period, and for repeating the operating and holding of said moving means if the condition generating one of said first and second signals is sensed at the end of the second preset time period.

* * * * *

Notice of Adverse Decisions in Interference

In Interference No. 102,736, involving Patent No. 4,842,559, J. J. Litjens, J. M. Griffiths, M. A. Karls, POSITION CONTROL SYSTEM FOR A MARINE PROPULSION DEVICE, final judgment adverse to the patentees was rendered June 3, 1992, as to claims 1-14.

*(Official Gazette August 25, 1992.)*